US006168475B1

(12) United States Patent
Ko

(10) Patent No.: US 6,168,475 B1
(45) Date of Patent: Jan. 2, 2001

(54) CONNECTOR ASSEMBLY HAVING ANTI-DISORIENTATION DEVICE

(75) Inventor: David Tso-Chin Ko, Thousands Oaks, CA (US)

(73) Assignee: Hon Hai Precision Ind. Co., Ltd., Taipei Hsien (TW)

( * ) Notice: Under 35 U.S.C. 154(b), the term of this patent shall be extended for 0 days.

(21) Appl. No.: 09/293,596

(22) Filed: Apr. 16, 1999

Related U.S. Application Data

(63) Continuation-in-part of application No. 09/075,508, filed on May 8, 1998.

(51) Int. Cl.[7] ..... H01R 13/64
(52) U.S. Cl. ..... 439/680; 439/677
(58) Field of Search ..... 439/680, 677

(56) References Cited

U.S. PATENT DOCUMENTS 4,764,129 * 8/1988 Jones et al. ..... 439/677
5,318,463 * 6/1994 Broschard, III et al. ..... 439/680
5,342,221 * 8/1994 Peterson ..... 439/677

* cited by examiner

*Primary Examiner*—Neil Abrams
*Assistant Examiner*—Javaid Nasri
(74) *Attorney, Agent, or Firm*—Wei Te Chung

(57) ABSTRACT

A connector assembly comprises a male connector defining a number of cavities. Each cavity having a header contact assembled therein. At least one cavity has at least a chamfered corner. A female connector forms a number of sleeve members corresponding to the cavities. Each sleeve member receives a receptacle contact therein. At least one sleeve member has at least a chamfered corner corresponding to the chamfered corner of the male connector. The sleeve member mechanically engages with the corresponding cavity when the male and female connectors are mated. Anti-disorientation means arranged between the male and female connectors includes a protrusion formed on an outer wall of at least one sleeve member of the female connector and a recess defined in an inner wall of at least one cavity of the male connector corresponding to the protrusion.

6 Claims, 2 Drawing Sheets

CONNECTOR ASSEMBLY HAVING ANTI-DISORIENTATION DEVICE

This is a continuation-in-part of the copending application Ser. No. 09/075,508, filed May 8, 1998.

FILED OF THE INVENTION

The present invention relates to a connector assembly, and more particularly to a connector assembly having an anti-disorientation device whereby erroneous upside-down mating between plug and receptacle connectors can be effectively eliminated.

DESCRIPTION OF PRIOR ART

The prevention of erroneous mating between plug and receptacle connectors is an essential issue to prevent damage from being incurred on electrical devices connected by the connectors. A power connector assembly includes a male connector having an array of cavities receiving headers therein, and a female connector having an array of sleeve members corresponding to the cavities. Each sleeve member is assembled with a receptacle which electrically engages with the header when the connectors are mated. However, a 2×9 or 1×11 matrix female connector can be easily inserted into a 2×11 matrix male connector resulting in improper signal transmission.

U.S. Pat. No. 4,979,912 discloses a matrix type electrical connector assembly having a male connector and a female connector mated together. A chamfer is formed on the male connector to cooperate with a flat surface defined in the female connector for ensuring correct mating therebetween. The '912 patent only discloses a "matrix type" connector assembly and the corresponding chamfer and flat surface corner structure respectively formed on the corners of the male connector and the female connector for ensuring correct mating orientation therebetween. However, this arrangement generally is located on either only one corner or two corners or even no corners of each sleeve member or cavity of the housings by following an unregulated format for compliance with anti-mismatching requirement. Thus, it is understood that even if under an upside-down erroneous mating, each pair of some sleeve members and the corresponding cavities only form one corner interference. Under this situation, there is no sufficient blocking finction occurring therebetween for efficiently preventing further deep insertion/mating thereof. Therefore, when the female connector is forcibly mated with the upside-down male connector, a thin wall of a cavity of the male housing is so flexible as to deformably receive the sleeve member of the erroneously upside-down aligned female connector, as shown in FIG. 1, even there are two corners with interference thereof. In other words, all the sleeve members are forcibly downwardly offset from their positions of correcting mating.

SUMMARY OF THE INVENTION

An objective of the present invention is to provide a connector assembly having anti-disorientation device for effectively preventing forcible mating between male and female connectors thereof.

In order to achieve the objective set forth, a connector assembly in accordance with a preferred embodiment of the present invention comprises a male connector defining a number of cavities. Each cavity has a header contact assembled therein. At least one cavity has at least a chamfered corner. A female connector forms a number of sleeve members corresponding to the cavities. Each sleeve member receives a receptacle contact therein. At least one sleeve member has at least a chamfered corner corresponding to the chamfered corners of the male connector. The sleeve member mechanically engages with the corresponding cavity when the male and female connectors are mated. Anti-disorientation means arranged between the male and female connectors includes a protrusion formed on an outer wall of at least one sleeve member of the female connector and a recess defined in an inner wall of at least one cavity of the male connector corresponding to the protrusion.

These and additional objects, features, and advantages of the present invention will become apparent after reading the following detailed description of the preferred embodiment of the invention taken in conjunction with the appended drawings.

DETAILED DESCRIPTION OF THE PREFERRED EMBODIMENT

Figure 3A:
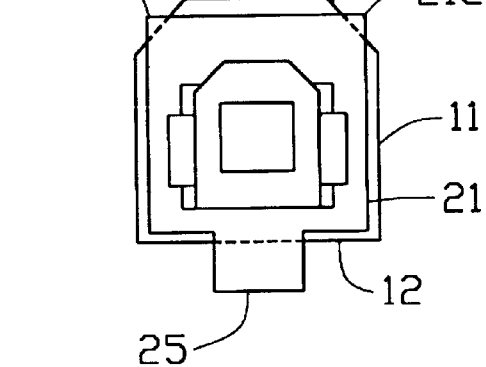
FIG. 3A is a schematic view showing a key of an outermost sleeve member being blocked by a wall of a cavity.
Figure 3B:
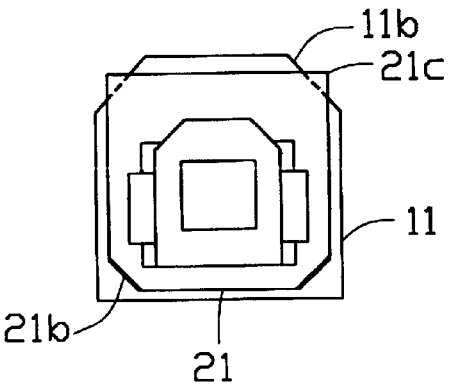
FIG. 3B is a schematic view showing corners of a sleeve member being blocked by chamfers of a cavity.
Figure 1:
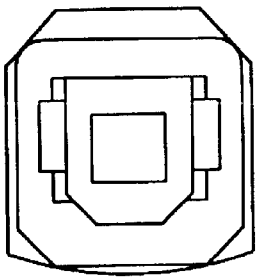
FIG. 1 (PRIOR ART)
FIG. 1 is a schematic illustration showing an arrangement of a conventional connector assembly.
Figure 2A:
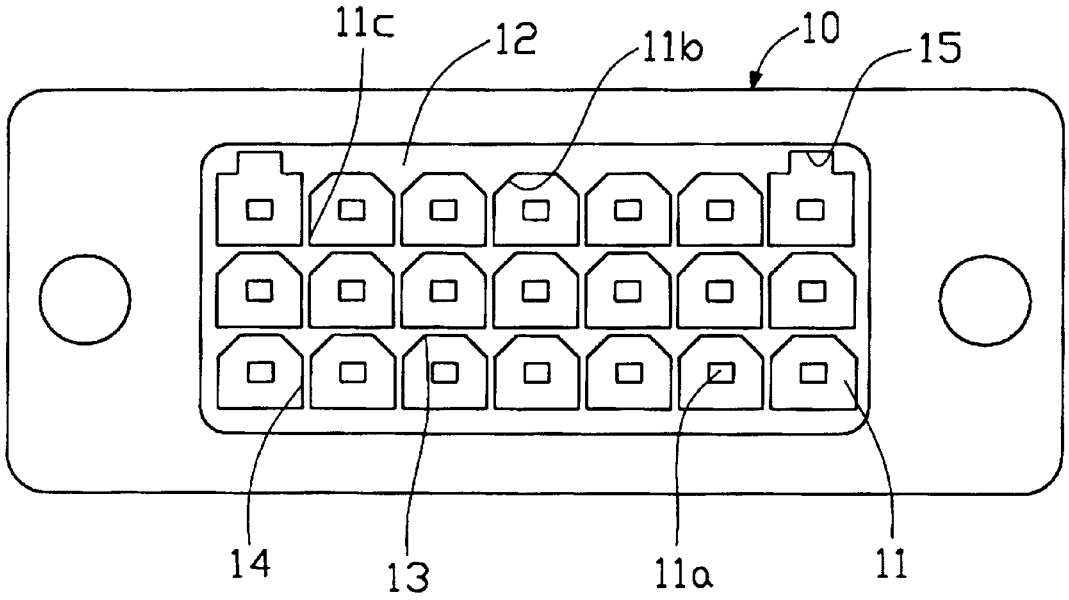
FIG. 2A is a front view of a male connector in accordance with the present invention.
Figure 2B:
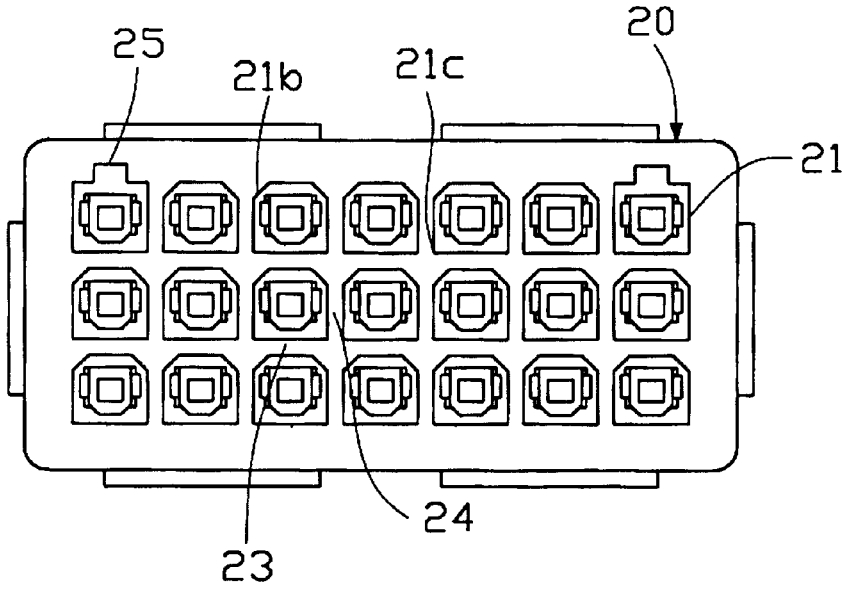
FIG. 2B is a front view of a female connector in accordance with the present invention.

Referring to FIGS. 2A, 2B, 3A, and 3B, a male power connector 10 in accordance with the present invention defines a 3×7 array of cavities 11. The male connector 10 is generally mounted on a PCB (not shown) of a system. Each cavity 11 is assembled with a header pin 11*a*. The cavities 11 are defined by a peripheral wall 12 and horizontal and vertical partitions 13, 14. The thickness of the wall 12 is larger than the thickness of the partitions 13, 14. Two cavities 11 located in an upper row of the array are respectively provided with keyways 15 for providing anti-disorientation capability. In the embodiment shown, the keyways 15 are defined in the cavities 11 located in upper left and right corners. The keyways 15 can be defined at other suitable positions. Each cavity 11 except the cavities 11 provided with the keyways 15 includes two chamfered corners 11*b* and two right angled corners 11*c* while the cavity 11 with the keyway 15 includes four right angled corners 11*c*.

A female connector 20 is mated with the male connector 10. The female connector 20 includes a 3×7 array of sleeve members 21 corresponding to the cavities 11 of the male connector 10. Each sleeve member 21 receives a female terminal (not shown) therein for mating with the header pin 11*a* of the corresponding cavity 11. Two sleeve members 21 are provided with keys 25 to be received in the corresponding keyways 15. In the embodiment shown, two keys 25 are provided on the upper right and left sleeve members 21 of the array corresponding to the keyways 15 of the male connectors 11. In addition, horizontal and vertical slits 23, 24 are defined between the sleeve members 21 for respectively receiving the horizontal and vertical partitions 13, 14 of the male connector 10. Each sleeve member 21 except the sleeve members 21 provided with the keys 25 includes two chamfered corners 21*b* and two right angled corners 21*c* corresponding to the chamfered corners 11*b* and right angled corners 11*c* of the corresponding cavities 11 of the male connector 10 while the sleeve member 21 with the key 25 includes four right angled corners 11*c*.

In assembly, if the male and female connectors 10, 20 are correctly aligned, the keys 25 are received in the corresponding keyways 15 and the sleeve members 21 are received in the corresponding cavities 11. On the contrary, if the male and female connectors 10, 20 are erroneously mated, the keys 25 will be blocked by the peripheral wall 12, and the right angled corners 21*c* of the sleeve members 21 will be blocked by the chamfered corners 11*b* of the cavities 11. Lines connecting engagement points between the key 25 and the peripheral 12 and between the chamfered corners 11*b* and the right angled corners 21*c* form a triangle (particularly referring to FIG. 3A), thereby creating a large area of resistance between the male and female connectors 10, 20. Thus, the forcibly upside-down mating of the two connectors 10, 20 is effectively prevented. In addition, because the outermost pair of sleeve members 21 and cavities 11 abut against each other without any tendency of deformation, the middle remaining cavities 11 which are not provided with keyways 25, are also without any tendency to be deformed for compensatorily receiving the erroneously inserted sleeve members 21 and thus such sleeve members 21 are blocked by engagement between the right angled corners 21*c* of the sleeve members 21 and the chamfer corners 11*b* of the corresponding cavities 11 thereby establishing complete blockage between the male and female connectors 10, 20.

It can be noted that in the invention, each of all the remaining sleeve members 21 and the corresponding cavities 11 is provided with a pair of chamfers at two opposite upper corners, thus creating an accumulated huge interference as a whole for either connector 11, 20 when both connectors 11 and 20 are erroneously upside-down mated with each other, thus efficiently allowing no disorientation. Anyhow, more than one half of the mated sleeve members and corresponding cavities with interference preferably at two corners for each pair, may efficiently prevent deformation thereof for anti-disorientation.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

I claim:

1. A connector assembly comprising:

a male connector defining at least two cavities divided by a partition, each cavity having a header contact assembled therein, at least one of the at least two cavities having a chamfered corner;

a female connector forming sleeve members corresponding to said cavities of said male connector, each sleeve member receiving a receptacle contact therein, at least one of the sleeve members having a chamfered corner corresponding to said chamfered corner of said male connector, said at least one sleeve member mechanically engaging with said corresponding cavity when said male and female connectors are mated; and anti-disorientation means arranged between said male and female connectors for preventing an erroneously upside-down mating of the male connector and the female connector, said anti-disorientation means including a protrusion formed on an outer wall of at least one of said sleeve members of said female connector and a recess defined in an inner wall of at least one of said cavities of said male connector corresponding to said protrusion.

2. The connector assembly as recited in claim 1, wherein said protrusion is a key.

3. The connector assembly as recited in claim 1, wherein said recess is a keyway.

4. A connector assembly comprising:

a male connector including an array of cavities having header contacts assembled therein, wherein two opposite outermost cavities further respectively define keyways;

a female connector including an array of sleeve members corresponding to the array of cavities of the male connector and receiving receptacle contacts therein for mechanically engaging with respective header contacts of the male connector, wherein two opposite outermost sleeve members further respectively define keys;

at least one of remaining cavities between said two outermost cavities defining at least one chamfer corner; and at least one of remaining sleeve members between said two outermost sleeve members defining at least one right angled corner; whereby through engagement between the right angled corner of the sleeve member and the chamfer corner of the cavity, and engagement between the key of the sleeve member and a partition of the male connector, an erroneously upside-down mating of the male connector and the female connector can be efficiently prevented.

5. The connector as recited in claim 4, wherein each of the remaining cavities defines a pair of chamfer corners.

6. The connector as recited in claim 4, wherein each of the remaining sleeve members defines a pair of right angled corners.

* * * * *